US008770288B2

(12) United States Patent
Kaminsky

(10) Patent No.: US 8,770,288 B2
(45) Date of Patent: Jul. 8, 2014

(54) DEEP STEAM INJECTION SYSTEMS AND METHODS

(75) Inventor: Robert D. Kaminsky, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 468 days.

(21) Appl. No.: 13/017,838

(22) Filed: Jan. 31, 2011

(65) Prior Publication Data

US 2011/0226473 A1 Sep. 22, 2011

Related U.S. Application Data

(60) Provisional application No. 61/315,225, filed on Mar. 18, 2010.

(51) Int. Cl.
*E21B 43/24* (2006.01)
*E21B 36/02* (2006.01)

(52) U.S. Cl.
USPC ..... 166/272.4; 166/401; 166/303; 166/59

(58) Field of Classification Search
None
See application file for complete search history.

(56) References Cited

U.S. PATENT DOCUMENTS 3,292,702 A * 12/1966 Boberg ..... 166/303
3,312,281 A * 4/1967 Belknap ..... 166/303
3,400,762 A * 9/1968 Peacock et al. ..... 166/258
3,410,345 A * 11/1968 Fradkin ..... 166/272.3
3,741,306 A * 6/1973 Papadopoulos et al. ... 166/252.1
3,774,684 A * 11/1973 Allen et al. ..... 166/303
3,878,884 A * 4/1975 Raleigh ..... 165/45
3,908,762 A * 9/1975 Redford ..... 166/402
3,980,137 A * 9/1976 Gray ..... 166/256
3,982,591 A * 9/1976 Hamrick et al. ..... 166/302
4,098,336 A * 7/1978 Allen ..... 166/261
4,109,720 A 8/1978 Allen et al.
4,324,291 A 4/1982 Wong et al.
4,344,485 A 8/1982 Butler (Continued)

FOREIGN PATENT DOCUMENTS

CA 1228020 10/1987

OTHER PUBLICATIONS

Farouq Ali, S.M. (2003) "Heavy Oil—Evermore Mobile" *Journal of Petroleum Science and Engineering*, 37(1), pp. 5-9, February.

(Continued)

*Primary Examiner* — Angela M DiTrani
*Assistant Examiner* — Anuradha Ahuja
(74) *Attorney, Agent, or Firm* — ExxonMobil Upstream Research Compnay—Law Department

(57) ABSTRACT

Systems and methods for creating high-pressure mixtures of steam and one or more noncondensable gas species, which may be injected into deep, high-pressured oil reservoirs to supply heat and aid oil recovery. These systems and methods may include generating these mixtures, also referred to as a combined stream, controlling the total pressure of the combined stream, controlling the partial pressure of steam within the combined stream, supplying the combined stream to a subterranean formation that includes hydrocarbons, such as viscous oil, reducing the viscosity of the oil, and/or producing oil from the subterranean formation. In some embodiments, the total pressure of the combined stream may approach or even exceed the critical pressure of water while still retaining significant amounts of latent heat for delivery. In some embodiments, the partial pressure of steam may be less than the critical pressure of water.

24 Claims, 6 Drawing Sheets

(56) References Cited

U.S. PATENT DOCUMENTS

| | | | | | |
|---|---|---|---|---|---|
| 4,471,839 | A | * | 9/1984 | Snavely et al. | 166/260 |
| 4,475,883 | A | * | 10/1984 | Schirmer et al. | 431/158 |
| 4,488,598 | A | | 12/1984 | Duerksen | |
| 4,499,946 | A | * | 2/1985 | Martin et al. | 166/57 |
| 4,558,740 | A | * | 12/1985 | Yellig, Jr. | 166/272.3 |
| 4,565,249 | A | | 1/1986 | Pebdani et al. | |
| 4,597,443 | A | * | 7/1986 | Shu et al. | 166/272.3 |
| 4,678,039 | A | * | 7/1987 | Rivas et al. | 166/303 |
| 4,753,293 | A | * | 6/1988 | Bohn | 166/267 |
| 4,756,369 | A | * | 7/1988 | Jennings et al. | 166/402 |
| 4,861,263 | A | * | 8/1989 | Schirmer | 431/158 |
| 5,020,596 | A | * | 6/1991 | Hemsath | 166/272.3 |
| 5,085,275 | A | | 2/1992 | Gondouin | |
| 7,363,973 | B2 | | 4/2008 | Nenniger et al. | |
| 7,540,951 | B2 | | 6/2009 | Selmen et al. | |
| 2003/0127400 | A1 | * | 7/2003 | Kresnyak et al. | 210/767 |
| 2006/0162923 | A1 | * | 7/2006 | Ware | 166/263 |
| 2007/0023186 | A1 | * | 2/2007 | Kaminsky et al. | 166/266 |
| 2008/0078552 | A1 | * | 4/2008 | Donnelly et al. | 166/303 |
| 2008/0290719 | A1 | * | 11/2008 | Kaminsky et al. | 299/3 |
| 2009/0020456 | A1 | * | 1/2009 | Tsangaris et al. | 208/133 |

OTHER PUBLICATIONS

Freitag, N.P. et al. (1998) "Comparison of Carbon Dioxide and Methane as Additives at Steamflood Conditions", *SPE Paper* 30297.

Hong, K.C., et al. (1984) "Effects of Noncondensable Gas Injection on Oil Recovery by Steamflooding", *SPE Paper* 11702.

* cited by examiner

DEEP STEAM INJECTION SYSTEMS AND METHODS

CROSS-REFERENCE TO RELATED APPLICATION

This application claims the priority benefit of U.S. Provisional Patent Application 61/315,225 filed 18 Mar. 2010 entitled DEEP STEAM INJECTION SYSTEMS AND METHODS, the entirety of which is incorporated by reference herein.

FIELD OF THE DISCLOSURE

The present disclosure is related generally to the oil and gas field, and more particularly to systems and methods for the injection of high-pressure steam-gas mixtures into oil-containing subterranean regions, such as to recover oil from the subsurface regions.

BACKGROUND OF THE DISCLOSURE

The production capacity of a liquid hydrocarbon-containing subterranean formation may be related to a wide array of factors, including the quantity of hydrocarbons present in the formation, the porosity and permeability of the formation itself, the pressure within the formation, the temperature within the formation, the viscosity of the hydrocarbons contained within the formation, the length of the wellbore that is exposed to the hydrocarbon-bearing strata, the presence of water, gas, and/or other materials within the formation, and a host of additional variables. Due to the variety of potential interactions among these various factors, the presence of hydrocarbons within a subterranean formation does not, in itself, indicate that the hydrocarbons may be economically recovered.

Historically, reservoirs containing conventional oil reserves that may be economically produced using traditional techniques have been the first to be developed. Many of these reservoirs are currently in a state of decline and/or have been depleted, at least with respect to oil that may be recovered with traditional techniques. Even when these reservoirs contain a large quantity of conventional oil, this oil may only make up a fraction of the total hydrocarbons contained within the well. In addition, conventional oil reserves only make up a fraction of the total, worldwide oil reserves. Thus, a wide variety of techniques have been developed to increase the overall recovery of conventional oil from a subterranean formation, as well as to facilitate the recovery of unconventional oil. Illustrative, non-exclusive examples of such methods include water injection, which may increase the pressure within the formation, and steam injection, which may increase both the pressure within the formation and the temperature of the oil contained therein, thus decreasing the oil's viscosity and allowing it to flow more readily. Other techniques include advances in well design and construction, such as the development of horizontal drilling technology, and the use of solvents to dissolve high-viscosity oil.

In the case of steam injection, high-pressure steam may be injected into the subterranean formation. As stated above, this steam may increase the pressure within the formation, increasing the driving force for oil flow out of the formation through a well. In addition, the steam may carry a significant amount of thermal energy, both sensible and latent, into the well. As the steam cools, it may release both sensible and latent heat and increase the temperature of the oil within the formation. As the oil temperature increases, its viscosity may decrease, allowing it to flow more easily from the formation and thereby increasing the overall oil recovery. Steam injection may be accomplished utilizing a variety of known techniques. For example, see: S. M. Farouq Ali, "Heavy Oil—Evermore Mobile," Journal of Petroleum Science and Engineering, 37(1), pp. 5-9, February 2003. Illustrative, non-exclusive examples of such techniques include steamflooding, steam assisted gravity drainage (SAGD), cyclic steamflooding, steam soak, and/or cyclic steam stimulation (CSS). While steam injection may be quite effective under certain conditions, it also has inherent limitations.

For example, as the pressure of steam is increased, its latent heat of vaporization decreases. At pressures approaching the critical pressure (3200 pounds per square inch absolute pressure (psia) (22 MPa) for pure water), the latent heat of vaporization of steam approaches zero. This decrease and/or elimination of the latent heat of vaporization at high pressures translates to a significant decrease in the ability of a given volume of near-critical and/or supercritical steam stream to transfer thermal energy to a subterranean formation and thus to oil within the formation. In addition, the density of this high-pressure steam may become liquid-like, and the volume change upon cooling may decrease as the pressure approaches the critical pressure, thereby decreasing the pressure increase within the formation for a given mass of steam injected. While this may be at least partially compensated for by a corresponding increase in the steam temperature, doing so may result in operating temperatures that may be in excess of the temperatures desirable for steam injection. Thus, at high pressures, traditional steam injection may become much less beneficial.

As a general rule of thumb, the pressure within many undisturbed reservoirs may be considered to increase by approximately 0.5 psia for each additional foot of reservoir depth (11 kPa for each additional meter of reservoir depth). Thus, the ambient pressure of deep oil reservoirs may approach and/or exceed the critical pressure of pure water and may preclude the efficient use of traditional steam injection methods for the reasons discussed herein. However, since steam injection is a well-established and generally cost-effective method for shallower reservoirs, systems and methods to extend steam injection to deep viscous oil reservoirs are of interest and would be of utility.

Traditional steam injection techniques have been modified in a variety of ways. One such modification is through coinjection with a noncondensable gas species. Illustrative, non-exclusive examples of these modifications are disclosed in U.S. Pat. Nos. 4,324,291 and 4,565,249, the disclosures of which are incorporated by reference. Additional illustrative, non-exclusive examples are disclosed in Canadian Patent No. 1,228,020, the 1984 SPE Paper 11702 by K. C. Hong and J. W. Ault, which is entitled "Effects of Noncondensable Gas Injection on Oil Recovery by Steamflooding," and the 1998 SPE Paper 30297 by N. P. Freitag and B. J. Kristoff, which is entitled "Comparison of Carbon Dioxide and Methane as Additives at Steamflood Conditions," the disclosures of which are incorporated by reference. However, these modifications have been made to aid sweep efficiency, to act as a solvent to reduce oil viscosity, and/or to act as an insulating blanket by forming a gas cap, and not to increase the depth at which steam injection may be effectively utilized.

SUMMARY OF THE DISCLOSURE

The present disclosure is directed to systems and methods for creating high-pressure mixtures of steam and one or more noncondensable gas species, and for using such mixtures to produce oil from a subterranean formation. The depth of the subterranean formation may be such that the ambient pressure within the formation approaches or exceeds the critical pressure of water, precluding the efficient use of traditional enhanced oil recovery techniques that include steam injection. The mixtures may be generated within a common vessel, in which water and noncondensable gas may be supplied and a combined stream comprising steam and the noncondensable gas may be produced. In some systems and/or methods according to the present disclosure, the combined stream may be generated in this common vessel and may not utilize a compressor to pressurize the noncondensable gas prior to delivery to the common vessel. The systems and methods may include controlling the total pressure of the combined stream to be near or greater than the critical pressure of water and/or controlling the partial pressure of steam within the combined stream to be less than the critical pressure of water so that the combined stream carries significant latent heat. The combined stream may be supplied to a subterranean formation that includes hydrocarbons, such as viscous oil, and it may increase the temperature of the viscous oil through thermal energy transfer from the combined stream to the viscous oil, thereby reducing its viscosity. This reduced-viscosity oil may be produced (i.e., recovered) from the subterranean formation.

DETAILED DESCRIPTION AND BEST MODE OF THE DISCLOSURE

Figure 1:
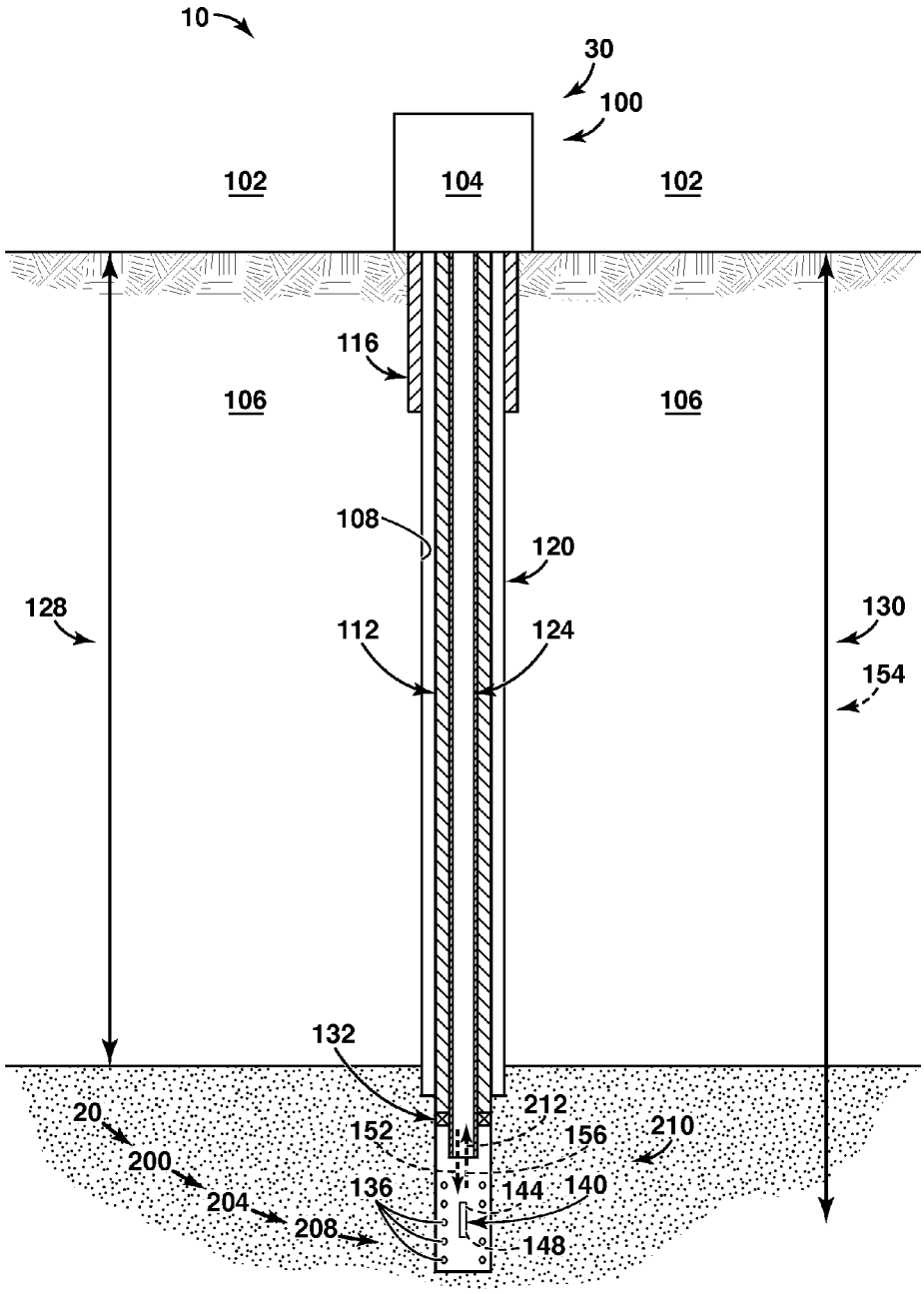
FIG. 1 is a schematic view of an illustrative, non-exclusive example of an oil well, such as with which deep steam injection systems and methods according to the present disclosure may be utilized.

The present disclosure is directed to systems and methods for creating high-pressure mixtures of steam and one or more noncondensable gas species. As discussed in more detail herein, these systems and methods may include generating the high-pressure mixture, which additionally or alternatively may be referred to as a combined stream, controlling the total pressure of the combined stream, controlling the partial pressure of steam within the combined stream, supplying the combined stream to a subterranean formation that includes hydrocarbons, such as viscous oil, reducing the viscosity of the oil, and/or producing oil from the subterranean formation. In some embodiments, the total pressure of the combined stream may be near or greater than the critical pressure of water. In some embodiments, the partial pressure of steam may be less than the critical pressure of water. In some embodiments, the combined stream may be injected into deep oil reservoirs, such as to aid in the production of oil from such reservoirs.

As used herein, "hydrocarbons" may refer to any number of carbon and hydrogen-containing compounds and/or mixtures of compounds that may be found contained within subterranean formations. Illustrative, non-exclusive examples of hydrocarbons according to the present disclosure may include petroleum, oil, crude oil, natural gas, tar, bitumen, and/or mixtures of these materials, as well as any other naturally occurring organic compound that may be found within subterranean geologic formations.

As used herein, "conventional oil" may refer to liquid hydrocarbons, such as crude oil, that may be produced from subterranean formations using traditional methods, such as well drilling and pumping. As used herein, "unconventional oil" and/or "non-conventional oil" may refer to liquid hydrocarbons that may not be readily recovered using traditional recovery methods. The terms oil, crude oil, petroleum, and liquid hydrocarbon may be used interchangeably.

As used herein, "noncondensable gas" refers to a gas, or gas species, that remains in a gaseous state at the temperatures and pressures that are likely to be encountered during processing within the system and/or within the subterranean formation. The temperature and pressure within a reservoir at a particular time may be referred to herein as the reservoir conditions. Thus, a "gas species" may be a single gaseous compound, or it may include two or more gases having different compositions. It is within the scope of the present disclosure that a reference to a gas species may be satisfied by a single gas composition, and vice versa, provided that this construction does not conflict with the other requirements of the corresponding reference. Accordingly, a "gas species" may be described as comprising at least one gas, or gaseous component. This includes gas species with normal boiling points of less than 40° C., such as boiling points of −200° C. to 0° C., −175° C. to −50° C., or −150° C. to −170° C. (at one atmosphere of pressure (101 kPa)). Illustrative, non-exclusive examples of noncondensable gases according to the present disclosure include natural gas, methane, ethane, propane, butane, pentane, carbon dioxide, and nitrogen, although any other suitable noncondensable gas and/or mixture of gases may be utilized. In some embodiments, the noncondensable gas may be selected to be readily separated from the hydrocarbon to be recovered from the subterranean reservoir, to not react chemically (or at least to be essentially chemically non-reactive) with the hydrocarbon to be recovered at the reservoir conditions and/or other components of the subterranean reservoir at the reservoir conditions, and/or to not contain oxygen (or at least to be essentially free of oxygen). However, these illustrative, non-exclusive examples of potential properties of the noncondensable gas are not required to all such gases to be utilized by systems and/or methods according to the present disclosure.

As used herein, "total pressure" refers to the absolute pressure, as referenced against zero pressure or pressure in a vacuum. The total pressure will be the sum of the individual, or partial pressures, of the gas and vapor-phase components that make up a particular stream or that fill a particular volume. For mixtures that behave as an ideal gas, the partial pressure of an individual component may be expressed as the product of the total pressure and the mole fraction of that component in the gas phase.

As used herein, "critical pressure of water" refers to the critical pressure of pure water, which is approximately 3200 psia (22.06 MPa).

As used herein, "high pressure" refers to pressures that approach or exceed the critical pressure of water. Illustrative, non-exclusive examples of high pressures according to the present disclosure include pressures greater than 1600 psia, including pressures greater than 2400 psia, greater than 2800 psia, greater than 3000 psia, greater than 3200 psia, greater than 3500 psia, greater than 4000 psia, and greater than 5000 psia.

As used herein, "deep oil reservoirs" refer to oil or hydrocarbon reservoirs wherein the ambient pressure approaches or exceeds the critical pressure of water.

Illustrative, non-exclusive examples of deep oil reservoirs according to the present disclosure include reservoirs with a depth of more than 2500 feet, including reservoirs with a depth of more than 3000 feet and reservoirs with a depth of more than 3500 feet.

As used herein, "viscous oil reservoirs" refer to unconventional subsurface formations, in which the viscosity of the hydrocarbons within the reservoir is such that they may not be readily produced using conventional oil recovery techniques. The oil viscosity that may cause it to behave as unconventional oil may vary significantly based on a variety of factors related to the formation containing the oil. Illustrative, non-exclusive examples of these factors include the porosity of the formation, the permeability of the formation, the depth of the formation, and/or the geometry of the formation. Illustrative, non-exclusive examples of "viscous oil" according to the present disclosure include oil with an initial in situ viscosity of greater than 10 centipoise (cp) under reservoir conditions, including oil with a viscosity greater than 50 cp, greater than 100 cp, greater than 1,000 cp, and/or greater than 10,000 cp. Under conditions where the oil reservoir behaves as a viscous oil reservoir, enhanced recovery techniques may be utilized to increase oil recovery.

As used herein, the term "supercritical" refers to a fluid that exists at a temperature and pressure that is above the fluid's critical point values. As an illustrative, non-exclusive example, the critical point of water occurs at a temperature of 374° C. and a pressure of 3200 psia (22 MPa). At temperatures and pressures above the critical point, there is no phase boundary between liquid water and gaseous water vapor (steam). Similarly, "subcritical" refers to a fluid that exists at a temperature and pressure that is below the fluid's critical point values.

An illustrative, non-exclusive example of a conventional oil well, such as with which deep steam injection systems and methods according to the present disclosure may be utilized is shown schematically in FIG. 1. In FIG. 1, hydrocarbon production system 10 includes a hydrocarbon well 30, in the form of an oil well 100, which may be a production well, an injection well, or a combination production/injection well. Oil well 100 may include a production tree 104 that serves to connect wellbore 108 to surface region 102. Production tree 104 typically will include suitable valves, fittings, and related structure to regulate and/or control access and/or fluid flow to and/or from the subterranean portion of the well. Well 100 may be created by any suitable method of construction and may include any suitable materials. This may include a one or more casings 112 that may aid in drilling of the well and may serve to reinforce the wellbore. A portion of the external surface of casings 112 may be sealed to the surrounding subsurface strata 106 using cement 116 or another suitable reinforcing material. Wellbore 108 may further include insulation 120 that may serve to decrease the transfer of thermal energy from within the wellbore to the surrounding subsurface strata. Within casing(s) 112, the wellbore may further include a plurality of pipes, tubes, sheaths, and/or linings 124, which may serve as conduits to convey material between a subterranean reservoir 20 and surface region 102. Packers 132 may be present to limit the flow of fluid into casings 112. A portion of casing(s) 112 may contain perforations 136, which may provide inlets for fluid to enter the wellbore and/or casing(s), such as for transport to the surface region, and/or which may provide outlets for delivery of fluid to the subterranean reservoir, such as from the surface region. For example, reservoir fluids 210, such as oil, natural gas, or other hydrocarbons, and/or water 156 may enter the casing through the perforations where they may be transported to the surface region via pipes 124. These reservoir fluids additionally or alternatively be referred to as produced fluids 210 when described in the context of fluids that are recovered or otherwise withdrawn or "produced" from the subterranean reservoir. The perforations additionally or alternatively may provide a path for injected fluids 152 to flow into subterranean reservoir 20. The wellbore may further include a down-hole heater 140, such as down hole electric heater 144 and/or down-hole fuel-fired heater 148.

As illustrated, hydrocarbon production system 10 extends into a subterranean reservoir 20 that contains hydrocarbons 212. The hydrocarbon production system additionally or alternatively may be described as being in fluid communication with the subterranean reservoir, such as to inject and/or withdraw fluids therefrom. The subterranean reservoir may comprise a subsurface formation 200, such as oil-bearing strata 204. The portion of oil-bearing strata 204 that is in fluid communication with hydrocarbon well 30 may be referred to as production zone 208. Subsurface formation 200 may be described as having a formation depth 128, and hydrocarbon well 30 may be described as having a (and/or an average) production depth 130 and/or an (and/or an average) injection depth 154. As schematically illustrated in FIG. 1, these depths are respectively measured from surface region 102 to the subsurface formation, the inlet in which produced fluids enter the wellbore, and the outlet from which injected fluids exit the wellbore. Although schematically indicated together in FIG. 1, injection depth 154 may be the same as, greater than, or less than production depth 130. Likewise, the production and/or injection depths will typically be greater than the formation depth. The pressure within subsurface formation 200 typically will be greater than, and often will be much greater than, the pressure in surface region 102, either naturally or due to the application of pumps. This pressure differential may cause oil to flow from subsurface formation 200, through oil well 100, to surface region 102 as produced fluid 210.

As discussed herein, traditional oil recovery techniques may be utilized successfully for the recovery of conventional hydrocarbon deposits. However, unconventional hydrocarbon deposits may require enhanced oil recovery techniques to facilitate and/or improve the recovery of oil from subterranean formations. An illustrative, non-exclusive example of an enhanced oil recovery technique, such as which may be utilized with systems and/or methods according to the present disclosure, is shown schematically in FIG. 2. The Figures, including previously discussed FIG. 1, presently discussed FIG. 2, and subsequent Figures of the present disclosure are schematically illustrated and are not intended to be drawn to scale, as they have been presented to emphasize and illustrate various aspects of the present disclosure. In the Figures, the same reference numerals designate like and corresponding, but not necessarily identical, elements throughout the various drawing Figures. Accordingly, when like-numbered elements are shown in two or more Figures, they may not be discussed in each such Figure, and it is within the scope of the present disclosure that the preceding discussion shall apply unless otherwise indicated. Similarly, where like-numbered elements, including illustrative values, compositions, subelements, variants thereof, and the like, are described in two or more portions of the present disclosure and/or in connection with two or more Figures, it is within the scope of the present disclosure that these illustrative values, compositions, variants thereof, and the like may be applied even if not repeated in the discussion at each occurrence.

Figure 2:
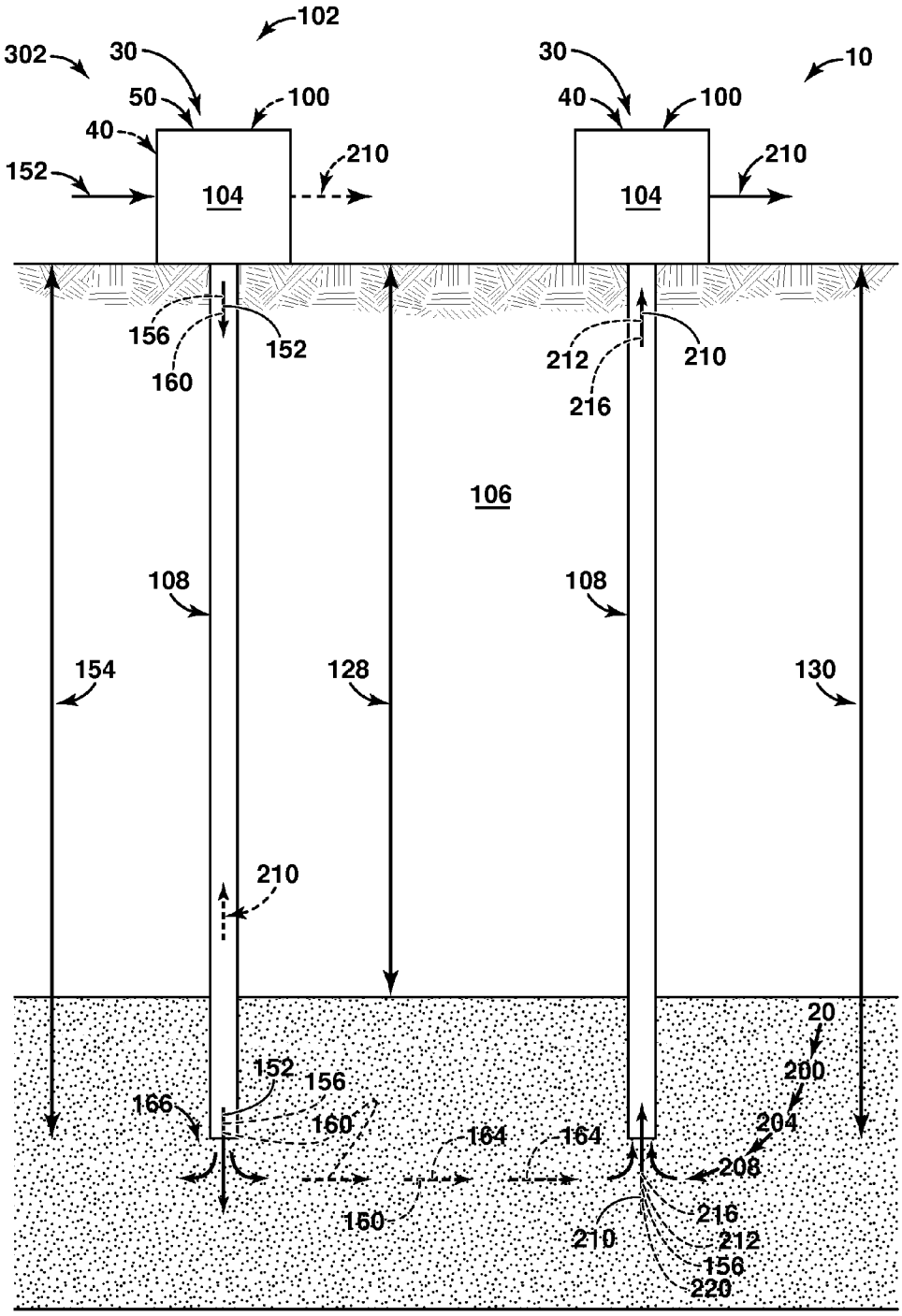
FIG. 2 is a schematic view of an illustrative, non-exclusive example of a hydrocarbon production system configured to implement a steamflood-enhanced oil recovery process, such as with which deep steam injection systems and methods according to the present disclosure may be utilized.

In FIG. 2, hydrocarbon production system 10 is schematically illustrated in a configuration for utilization of a steamflood process and includes a subterranean reservoir 20 and a plurality of hydrocarbon wells 30 extending within subsurface strata 106. Hydrocarbon wells 30 may be substantially similar to the well of FIG. 1 or may take any other suitable form and may be injection wells, production wells, and/or combination injection and production wells. In FIG. 2, two wells 30 have been schematically depicted, with one well being designated as a production well 40, and the other well being designated as an injection well 50. While only one injection well and one production well are shown in FIG. 2, it is within the scope of the present disclosure that a plurality of injection wells and a plurality of production wells may be utilized. The number of injection wells may be equal to the number of production wells, greater than the number of production wells, or less than the number of production wells without departing from the scope of the present disclosure. Furthermore, some wells 30 may be utilized as both an injection well and a production well. This is schematically illustrated in FIG. 2, in which injection well 50 also is designated with dashed lead lines to be a production well 40, from which produced fluid 210 may be removed from the subterranean formation.

In a steamflood process, injected fluid 152, such as steam 160 and/or liquid water 156, may be injected into injection wells 50. The injected steam may enter subsurface formation 200, including oil-bearing strata 204, and optionally a production zone 208 thereof, at injection depth 154 and establish a pressure gradient within the subsurface formation, wherein the pressure at injection point 166 may be higher than the pressure in other portions of the formation. Illustrative, non-exclusive examples of differential pressures between adjacent, or "neighboring," injection and production wells may be pressures greater than 50 psi (345 kPa), greater than 200 psi (1.4 MPa), greater than 500 psi (3.4 MPa), or even greater than 1500 psi (10.3 MPa). As the steam, driven by this pressure gradient, travels through subsurface formation 200, it may transfer thermal energy, in the form of both sensible heat and latent heat, to the formation, including hydrocarbons 212, such as oil 216. As the temperature of oil 216 increases, its viscosity may decrease and it may flow to production well 40, where it may be transported to surface region 102 as produced fluid 210. As steam 160 transfers thermal energy to the formation, its temperature may decrease and it may experience a phase change, release its latent heat of vaporization, and become hot water 164. Driven by the pressure gradient, this hot water may continue to travel through subsurface formation 200, further heating the oil and pushing it toward production wells 40. This is schematically illustrated in FIG. 2, in which dashed arrows are utilized to depict steam 160 from injection well 50 flowing toward production well 40, and in the course of doing so, transitioning to water 164. Oil 216 may enter the productions wells, where it may be transported to surface region 102 as produced fluid 210.

It is within the scope of the present disclosure that hydrocarbon well 30 of FIGS. 1 and 2 may have any depth suitable for the production of hydrocarbons from subsurface formation 200. It is also within the scope of the present disclosure that the length of the wellbore that is exposed to oil-bearing strata 204 may vary and that wellbore 108 may include vertically and/or horizontally drilled portions. As an illustrative, non-exclusive example, hydrocarbon well 30 according to the present disclosure may be constructed such that the wellbore is substantially vertical prior to entering oil-bearing strata 204. After entering oil-bearing strata 204, wellbore 108 may continue to be substantially vertical. However, wellbore 108 also may take on any suitable orientation, such as to increase the length of hydrocarbon well 30 that is contained within oil-bearing strata 204. As an illustrative, non-exclusive example, if oil-bearing strata 204 are disposed on a substantially horizontal plane, then wellbore 108 may have a substantially horizontal orientation within the wellbore.

It is further within the scope of the present disclosure that hydrocarbon well 30 may be a multiple completion well. By "multiple completion," it is meant that hydrocarbon well 30 may include a plurality of injection depths (and/or injection regions) and/or a plurality of production depths (and/or production regions). When hydrocarbon well 30 includes injection well 50, it is within the scope of the present disclosure that the injection rate and/or target pressure at injection point 166 may vary. Illustrative, non-exclusive examples of target pressures according to the present disclosure include pressures that are less than the fracture pressure of subsurface formation 200; however, pressures in excess of the fracture pressure also may be used. As used herein, "fracture pressure" refers to the pressure required to fracture the subsurface formation. This pressure may vary significantly depending on the composition and depth of subsurface formation 200.

Additional illustrative, non-exclusive examples of enhanced oil recovery techniques that utilize steam injection and with which systems and/or methods according to the present disclosure may be utilized include cyclic steam stimulation (CSS), steam assisted gravity drainage (SAGD), cyclic steamflooding, and steam soak. In cyclic steam stimulation, a single well may be utilized for both injection and production. A CSS process may include supplying steam to the subterranean reservoir for a first period of time, allowing the steam to soak within the reservoir for a second period of time, and producing oil from the reservoir for a third period of time. The cycle may then be repeated as desired.

Steam assisted gravity drainage may be substantially similar to steamflood process 302 discussed herein; however, two horizontal, substantially parallel oil wells may be drilled into the subterranean reservoir, one above the other. Steam may then be injected into the upper well, where it may increase the temperature of the oil within the reservoir, reducing its viscosity. This reduced-viscosity oil may flow by gravity and/or pressure gradient to the lower well, where it may be collected and transported to surface region 102 as produced fluid 210. Illustrative, non-exclusive examples of the steam assisted gravity drainage process are disclosed in U.S. Pat. No. 4,344,485, the complete disclosure of which is incorporated by reference.

Cyclic steamflood or steam soak is a combination of CSS and steamflood, wherein standard steamflood techniques are utilized but the production wells are also periodically steam stimulated. While steamflood, cyclic steam stimulation, steam assisted gravity drainage, cyclic steamflood, and steam soak processes have been described in some detail herein, the deep steam injection systems and methods of the present disclosure may be utilized with other oil recovery techniques and/or processes.

As discussed herein, enhanced oil recovery techniques that utilize steam injection may be used to increase the recovery of viscous oil from subterranean formations by increasing the pressure within the formation, providing an increased driving force for oil production, and/or by increasing the temperature of the oil, thereby decreasing its viscosity and thus its resistance to flow. Steam may transfer thermal energy to the subterranean formation through both sensible and latent heat effects.

The amount of thermal energy that may be transferred from a steam stream by sensible heat effects may be described by:

$$Q_{sensible}=m_s \cdot c \cdot \Delta T$$

In the above equation, $Q_{sensible}$ is the rate at which sensible heat is transferred from the steam stream (kJ/s), $m_s$ is the mass flow rate of the steam stream (kg/s), c is the average specific heat capacity of the steam stream (for example, approximately 2.1 kJ/kg·° C. at 100° C. and 101 kPa) over the temperature range of interest, and ΔT is the temperature change of the steam stream (° C.).

The amount of thermal energy that may be transferred from the steam stream by latent heat effects may be described by:

$$Q_{latent}=m_L \cdot L$$

In the above equation, $Q_{latent}$ is the rate at which latent heat is transferred from the steam stream (kJ/s) due to condensation of the steam into water, $m_L$ is the rate at which steam is condensed into water (kg/s), and L is the latent heat or enthalpy of vaporization of water (kJ/kg).

Figure 3:
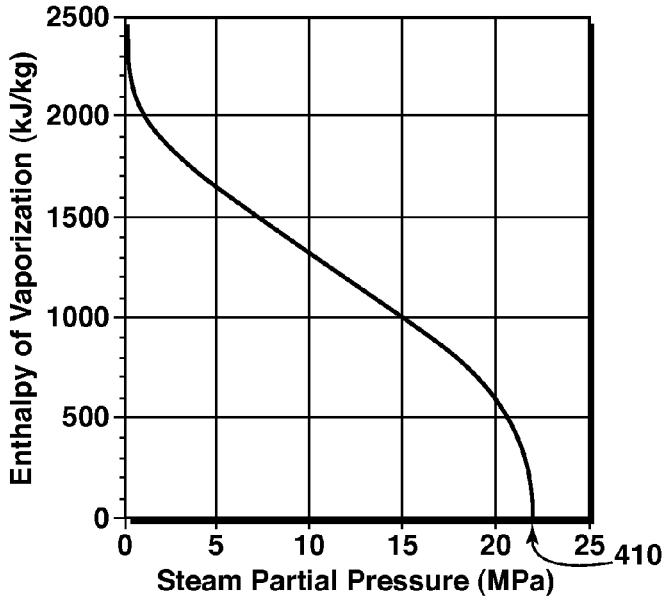
FIG. 3 is a plot of the enthalpy of vaporization of water as a function of the partial pressure of water in the vapor phase.

In general, the amount of thermal energy that may be transferred from subcritical steam due to latent heat effects may be much larger than the amount of thermal energy that may be transferred by sensible heat effects. This is due to the large magnitude of the enthalpy of vaporization, which may be approximately 2250 kJ/kg or more at lower pressures. However, the enthalpy of vaporization of water is a function of the partial pressure of the gaseous-phase water, or steam, in equilibrium with the water. This is shown in FIG. 3, which plots the enthalpy of vaporization of water as a function of the partial pressure of steam in equilibrium with the water. As can be seen from FIG. 3, the enthalpy of vaporization decreases monotonically with increasing pressure and reaches zero at the critical pressure of water, or 22.0 MPa (3200 psia), shown at 410. Above the critical pressure, there is no distinction between the liquid and gas phases and thus, there are no latent heat effects.

Thus, as the steam partial pressure increases, the amount of thermal energy that may be transferred from the steam stream due to latent heat effects decreases. As discussed herein, it may be desirable to utilize steam injection in viscous oil reservoirs to aid in the recovery of unconventional hydrocarbon deposits. In addition, the depth of these unconventional hydrocarbon deposits may be such that the ambient pressure within the reservoir approaches or exceeds the critical pressure of water. Under these conditions, steam injection may be utilized to increase oil recovery; however, heat transfer to the viscous oil within the reservoir due to latent heat effects may be minimal or zero and all heating may be by sensible heat effects. In addition, and as discussed herein, the density of the steam stream increases with increasing pressure, approaching liquid-like densities at pressures above the critical pressure. Thus, the pressure increase within the subsurface formation per unit mass of injected supercritical steam may be much less than that obtained with sub-critical steam. Under these conditions, a much larger volume of steam may need to be injected to provide the pressure driving force necessary for viscous oil recovery. Any of these factors may limit the effectiveness of steam injection in deep, viscous oil reservoirs.

One method for extending enhanced oil recovery techniques that utilize steam injection to deep, viscous oil reservoirs may be through coinjection of a combined stream that includes both noncondensable gas and steam. The combination of noncondensable gas and steam may offer several benefits. For example, coinjection of a combined stream may provide independent control of the total pressure of the combined stream and the partial pressure of steam within the combined stream. In addition, the generation of the combined stream within a steam generator may enable the use of subcritical steam generation technology to generate a high-pressure steam-coinjectant mixture at a total pressure that is above the critical pressure of water. Also, the noncondensable gas may retain its gas-like pressure-volume-temperature behavior within the subterranean reservoir, even at pressures that exceed the critical pressure of water, thereby requiring a smaller mass of injectant to produce a given reservoir pressure when compared to a condensable injectant.

Figure 4:
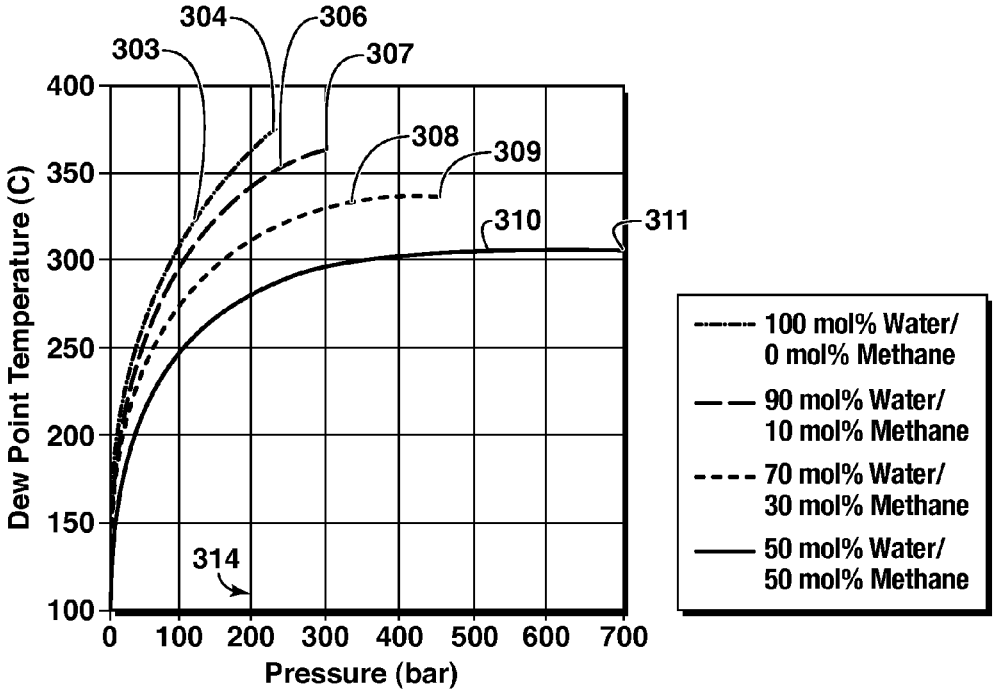
FIG. 4 is a plot of the dew point of water-methane mixtures.

An illustrative, non-exclusive example of the thermodynamic properties of a noncondensable gas-steam mixture according to the present disclosure, in the form of dew point temperature vs. total pressure plots for mixtures of water and methane is shown in FIG. 4. As discussed, methane and natural gas are illustrative, non-exclusive examples of noncondensable gases that may be used with systems and methods according to the present disclosure. FIG. 4 plots the dew point temperature for pure water and various water-methane mixtures up to the cricondentherm, that is, the maximum temperature and pressure at which liquid and gas phases may exist in equilibrium with each other. FIG. 4 is based on calculations performed using the Peng-Robinson equation of state.

Pure water (curve 303) shows an increase in dew point temperature with pressure up to the critical point of pure water at 304 (220.6 bar and 374° C.). The addition of methane as shown in curves 306 (90 mol % water and 10 mol % methane), 308 (70 mol % water and 30 mol % methane), and 310 (50 mol % water and 50 mol % methane) causes a monotonic decrease in the temperature of the cricondentherm. The addition of methane also causes and a monotonic increase in the pressure of the cricondentherm, as shown by points at 307, 309, and 311, respectively, as well as a decrease in the boiling point temperature at a given pressure, which may be seen from the intersection of each of curves 303, 306, 308, and 310 with 200 bar pressure line 314. Although only illustrative, non-exclusive examples, all three of these trends may be beneficial for steam injection into deep oil reservoirs. The observed decrease in cricondentherm temperature and the corresponding decrease in boiling point temperature at a given pressure may enable the injection of noncondensable gas-water mixtures into subterranean formations at lower temperatures, thereby decreasing the energy required to heat and/or vaporize the mixture. The increase in cricondentherm pressure may enable the injection to take place at higher pressures, while still maintaining the ability of the steam within the mixture to transition from the gas phase to the liquid phase, thus preserving the benefits of the latent heat effects as discussed herein.

While FIG. 4 provides an illustrative, non-exclusive example of certain steam-methane mixtures that may be utilized according to the present disclosure, it is within the scope of the present disclosure that other mixtures may be utilized. This may include steam-methane mixtures with other compositions, mixtures of steam and another noncondensable gas, and/or mixtures of steam and a plurality of gases, at least one of which is a noncondensable gas.

Figure 5:
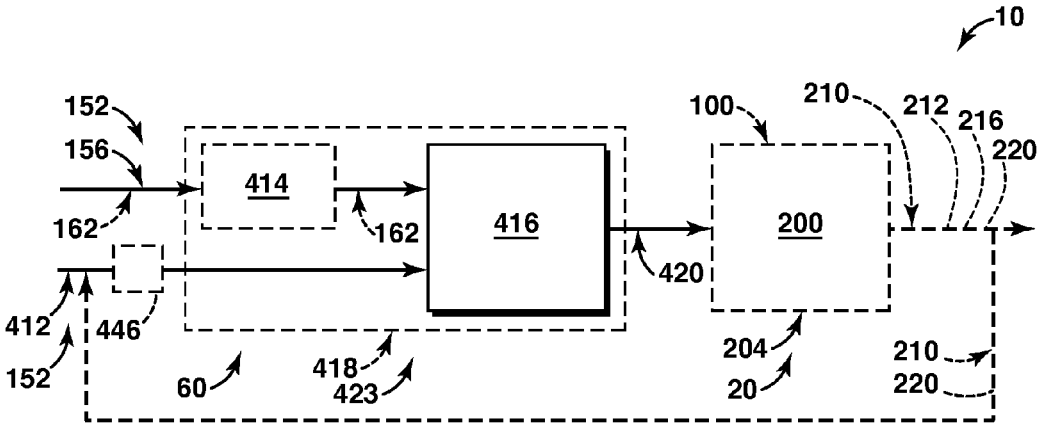
FIG. 5 is a schematic, illustrative, non-exclusive example of a coinjection system according to the present disclosure.

A schematic diagram of an illustrative, non-exclusive example of a system for creating a high-pressure mixture of steam and a non-condensable gas species according to the present disclosure is shown in FIG. 5. In FIG. 5, hydrocarbon production system 10, including injectant generation assembly 60 and subterranean reservoir 20, is shown. Injected fluids 152, in the form of water 156 and/or steam 162 and noncondensable gas 412, may be supplied to fluid mixing assembly 423. As used herein, injected fluids 152 may additionally or alternatively be referred to as injectant fluids, and this latter term optionally may be preferred when referring to the fluids prior to being injected into the subsurface region, such as into a subterranean (oil) reservoir thereof. Steam 162 and noncondensable gas 412 may be supplied to mixing volume 416, where they may be combined to produce combined stream 420. Typically, noncondensable gas 412 will form at least 5 mol % of the combined stream, and may comprise such illustrative amounts as at least 10 mol %, at least 20 mol %, and/or at least 30 mol % of the combined stream. Steam may form the remaining portion of the combined stream, and often will form the majority component of the combined stream, including forming at least 50 mol %, at least 60 mol %, at least 70 mol %, at least 80 mol %, or more of the combined stream. It is further within the scope of the present disclosure that combined stream may include one or more additional components, although in many embodiments it may include only steam 162 and noncondensable gas 412.

As discussed herein, and although not required to all systems and methods according to the present disclosure, the mixing volume may be located at, or in, the surface region, and the combined stream may be generated at a pressure that is at, or exceeds, the critical pressure of pure water. Mixing volume 416 may additionally or alternatively be, or be referred to as, a mixing tank, reservoir, and/or pressure vessel. Additionally or alternatively, fluid mixing assembly 423 may optionally include a steam generator 414 that may receive liquid water 156 and produce steam therefrom, such as in the form of a steam stream 162. In such a configuration, the fluid mixing assembly may additionally or alternatively be referred to as fluid heating assembly 423 and/or as a fluid mixing and heating assembly 423.

The combined stream may optionally be supplied to a subsurface formation 200, such as via an oil well 100 to oil-bearing strata 204, and produced fluids 210, such as hydrocarbons 212, oil 216, and/or natural gas 220 may be produced from formation 200. When the produced fluids include natural gas or another gaseous species that is suitable for use as noncondensable gas 412, it is within the scope of the present disclosure that at least a portion of the produced fluids from the subsurface formation may be utilized to generate additional combined stream 420, as indicated in dashed lines in FIG. 5. In some such systems and/or methods, an optional compressor 446 may be utilized to increase the pressure of this portion of the produced fluids and/or of any other noncondensable gas 412.

It is within the scope of the present disclosure that steam generator 414 may be separate and distinct from mixing volume 416, or that steam generator 414 be integrated into and/or form a portion of mixing volume 416, such that steam generation and mixing may be accomplished within a common vessel 418. In some systems and/or methods according to the present disclosure, liquid water 156 and noncondensable gas 412 may be delivered to the common vessel of the mixing volume as the water is vaporized. It is within the scope of the present disclosure that in such a configuration, the combined stream may be generated in this common (pressure) vessel and may not utilize a compressor to pressurize the noncondensable gas prior to delivery to the common vessel. Instead, the pressure generated through the vaporization of the liquid water in the common vessel may be sufficient to provide combined stream with a sufficient total pressure, partial pressure of steam, and related properties for successful utilization for recovery of viscous oil from subterranean formations, including deep subterranean formations.

It is further within the scope of the present disclosure that at least a portion of injectant generation assembly 60 be located within surface region 102 and/or that at least a portion of injectant generation assembly 60 be located within a wellbore and/or within a subsurface region. It is also within the scope of the present disclosure that combined stream 420 may be supplied to subsurface formation 200 using any suitable method, illustrative, non-exclusive examples of which are described herein and which may include any continuous, intermittent, and/or cyclical supply of steam.

Figure 6:
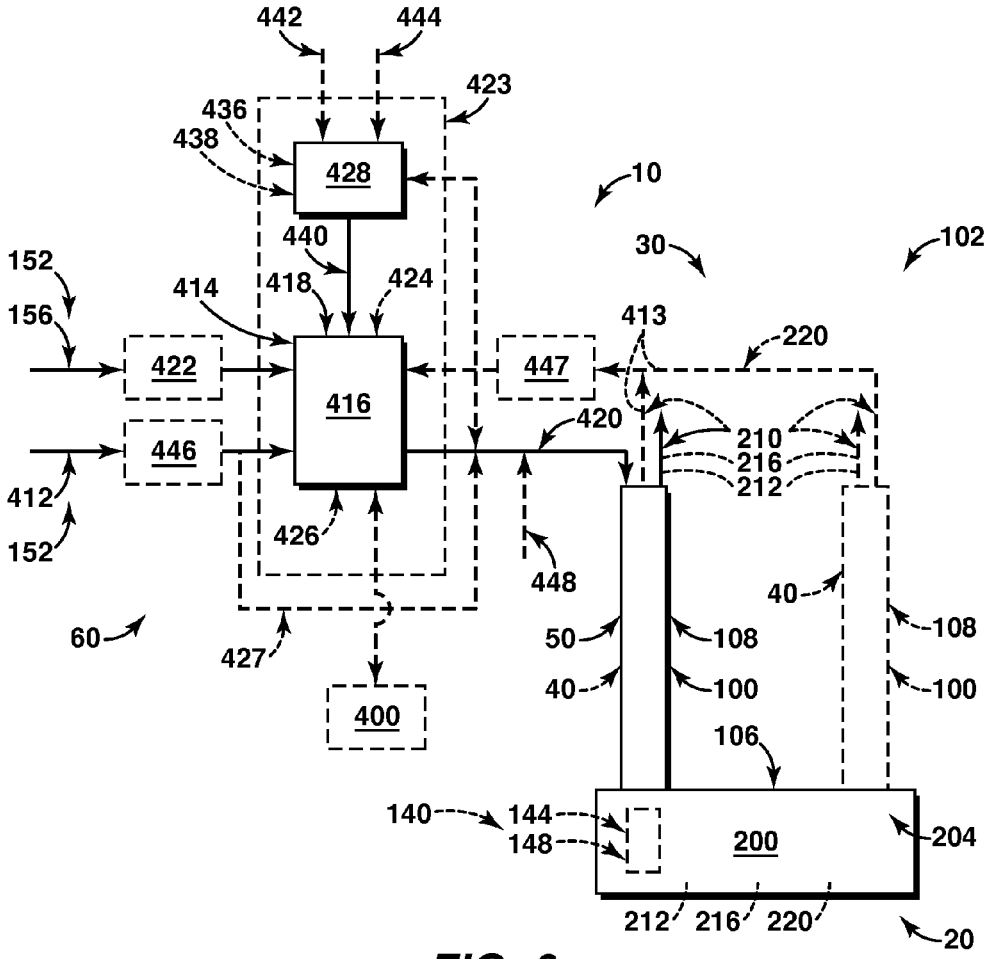
FIG. 6 is a schematic, illustrative, non-exclusive example of another coinjection system according to the present disclosure.

A less schematic diagram of an illustrative, non-exclusive example of a system for creating a high-pressure mixture of steam and a non-condensable gas species according to the present disclosure is shown in FIG. 6. In FIG. 6, hydrocarbon production system 10 includes injectant generation assembly 60, which may be in fluid communication with subterranean reservoir 20 through a plurality of hydrocarbon wells 30, which may be production wells 40, injection wells 50, or injection/production wells.

Injectant generation assembly 60 may receive injected fluids 152, in the form of (liquid) water 156 and noncondensable gas 412. Water 156 may be pressurized by an optional pump 422 before being supplied to fluid mixing assembly 423, while noncondensable gas 412 may be pressurized by an optional compressor 446 before being supplied to fluid mixing assembly 423. Fluid mixing assembly 423 may include a mixing volume 416 that may comprise any vessel 418 suitable for combining injected fluids 152, such as to generate the pressurized combined stream 420. Illustrative, non-exclusive examples of a suitable mixing volume 416 according to the present disclosure include a tank, pressure tank, pressure vessel, steam generator, superheater, heat exchanger, boiler 424, and/or heated pipe 426. Mixing volume 416 may be sealed such that injected fluids 152 may only exit via suitable conduits and may be designed to withstand a high internal pressure, such as pressures of at least 2500 psia, 3000 psia, 3500 psia, 4000 psia, or 5,000 psia. When present, pump 422 may include any suitable structure for increasing the pressure of water 156. Illustrative, non-exclusive examples of pump 422 according to the present disclosure include a suitable centrifugal, rotary vane, diaphragm, bellows, drum, flexible liner, flexible impeller, gear, peristaltic, progressive cavity, rotary lobe, and/or positive displacement pump. When present, compressor 446 may include any suitable structure for increasing the pressure of noncondensable gas 412. Illustrative, non-exclusive examples of compressor 422 according to the present disclosure include a suitable reciprocating, rotary screw, and/or centrifugal compressor.

Fluid mixing assembly 423 may further include a heater 428, in the form of fuel-fired heater 436 and/or electric heater 438 that is adapted to convert fuel 442 and/or electricity 444 to a heat stream 440 that may be used to heat mixing volume 416. As discussed, this heat may be used to vaporize liquid water 156 to form steam, and in such a configuration, fluid mixing assembly 423 and/or mixing volume 416 may additionally or alternatively be described as including, or being, a steam generator 414. Combined stream 420, comprising noncondensable gas 412 and steam 162 and/or water 156, may be generated from injected fluids 152 at injectant generation assembly 60 and supplied to hydrocarbon well 30, such as injection well 50. The temperature, total pressure, partial pressure of the components that comprise combined stream 420, and/or other relevant characteristics of the combined stream and/or the injectant generation assembly may be maintained, regulated, or otherwise controlled, such as to be, or to correspond to, target and/or threshold values. This may be accomplished using any suitable structure, illustrative, non-exclusive examples of which include valves, check valves, orifices, and/or flow control devices. This structure, when utilized, may be connected using any suitable conduit and may be used to control the flow rate of injected fluids 152 to and the flow rate of combined stream 420 from injectant generation assembly 60. The rate of thermal energy transfer from heater 428 to mixing volume 416 via heat stream 440 may be controlled using any suitable structure. When heater 428 includes electric heater 438, this control may include controlling heat production by controlling the flow of electricity 444 to the electric heater. When heater 428 includes fuel-fired heater 436, this control may include controlling heat production by controlling the supply of fuel 442 to the fuel-fired heater. In addition, the quantity of heat transferred via heat stream 440 also may be controlled. The status of injectant generation assembly 60 may be monitored using any suitable detectors and/or transducers, illustrative, non-exclusive examples of which include temperature sensors, pressure sensors, strain gauges, fluid metering devices, chemical composition detectors, and/or other devices adapted to monitor the temperature, pressure, and/or chemical composition of injected fluids 152 and/or combined stream 420.

In the above discussion of hydrocarbon production system 10, the opening and closing of appropriate valves, the selection of appropriate flow rates, and the control of the temperature, pressure, and/or chemical composition of the combined stream may be accomplished via any suitable manner or mechanism. For example, this control may be implemented manually by the user, through the use of a controller 400, or by a combination of the two. Controller 400 may include any suitable type and number of devices or mechanisms to implement and provide for the desired monitoring and/or control of the hydrocarbon production system. As illustrative, non-exclusive examples, a suitable controller may take the form of analog and/or digital circuitry, together with appropriate electronic instructions that may be stored on magnetic media or programmable memory such as read only memory (ROM), programmable read only memory (PROM), or erasable programmable read only memory (EPROM), and may be integrated into the hydrocarbon production system or be a separate, stand-alone computing device. The controller may be adapted or otherwise programmed or designed to control the operation of hydrocarbon production system 10 in the plurality of operating states of the system, including optionally controlling the transitions of the assembly among the various states. The controller, when present, also may include and/or be in communication with various sensors and/or status signals.

It is also within the scope of the present disclosure that the individual components of hydrocarbon production system 10, including hydrocarbon well 30 and/or injectant generation assembly 60, may include dedicated or even integrated controllers that are adapted to monitor and/or control the operation of these components and, where applicable, control the transitions of these components between their respective operating states. As an illustrative, non-exclusive example, injectant generation assembly 60 may include or be in communication with controller 400 that may be adapted to monitor and/or control the operation thereof, including configuring the assembly between its operating states.

When hydrocarbon production system 10 includes two or more controllers, the controllers may be in communication with each other. It is also within the scope of the present disclosure that the hydrocarbon production system may include a single controller that monitors and/or controls the operation of two or more components thereof, such as mixing volume 416 and heater 428.

As discussed herein and shown in FIG. 6, injectant generation assembly 60 may supply combined stream 420 to subterranean reservoir 20, such as to subsurface formation 200 and/or oil-bearing strata 204. The combined stream may transfer thermal energy to the oil-bearing strata, including any hydrocarbons 212 and/or oil 216 present within strata 204, thereby reducing the viscosity of the oil. The reduced-viscosity oil may flow to production well 40, where it may be transported to surface region 102 as produced fluid 210. Although not required to all systems and/or methods according to the present disclosure, produced fluid 210 may include natural gas 220 and/or other produced noncondensable gas species 413 that may be supplied to a compressor 447 and then to injectant generation assembly 60 in addition to, or as an alternative to, noncondensable gas 412. Additionally and/or alternatively, produced noncondensable gas 413 may be mixed with the combined stream to increase the concentration of noncondensable gas in the combined stream prior to and/or during injection into subsurface formation 200. Produced noncondensable gas 413 also may be used as a fuel for heater 428, such as for fuel-fired heater 436. It is within the scope of the present disclosure that at least a portion of noncondensable gas 412 may bypass mixing volume 416 in bypass conduit 427 and be mixed with combined stream 420, such as through the use of suitable valves and/or controls to enable this selective bypassing.

As discussed herein, it is also within the scope of the present disclosure that wellbore 108 and/or subsurface formation 200 may include a down-hole heater 140, such as down-hole electric heater 144 and/or down-hole fuel-fired heater 148. Down-hole heater 140 may be utilized to increase the temperature within wellbore 108 and/or subsurface formation 200 before, during, and/or after injection of combined stream 420. As an illustrative, non-exclusive example, down-hole heater 140 may be used to increase the temperature within wellbore 108 and/or subsurface formation 200 prior to the injection of combined stream 420. This may decrease the impact of heat loss from the combined stream as it travels through the wellbore and/or while it is within the vicinity of the wellbore within subsurface formation 200. When a down-hole heater in the form of a fuel-fired heater 148 is utilized, the heater may have fuel, air, and exhaust conduits that are separated from the injected and/or produced fluids within well(s) 30 and or subterranean reservoir 20. As another illustrative, non-exclusive example, down-hole heater 140 may be used to maintain the temperature of the wellbore and/or the subsurface formation during and/or after injection of combined stream 420. This may decrease temperature fluctuations within the subsurface strata in situations in which the combined stream is not injected continuously such as, for example, in CSS, steam soak, and/or cyclic steamflood processes.

It is further within the scope of the present disclosure that a well preheat stream 448 may be supplied to injection well 50 and subsurface formation 200 prior to, during, and/or after supplying the combined stream. Well preheat stream 448 may include steam or any other suitable fluid and may serve a similar purpose to down-hole heater 140.

Figure 7:
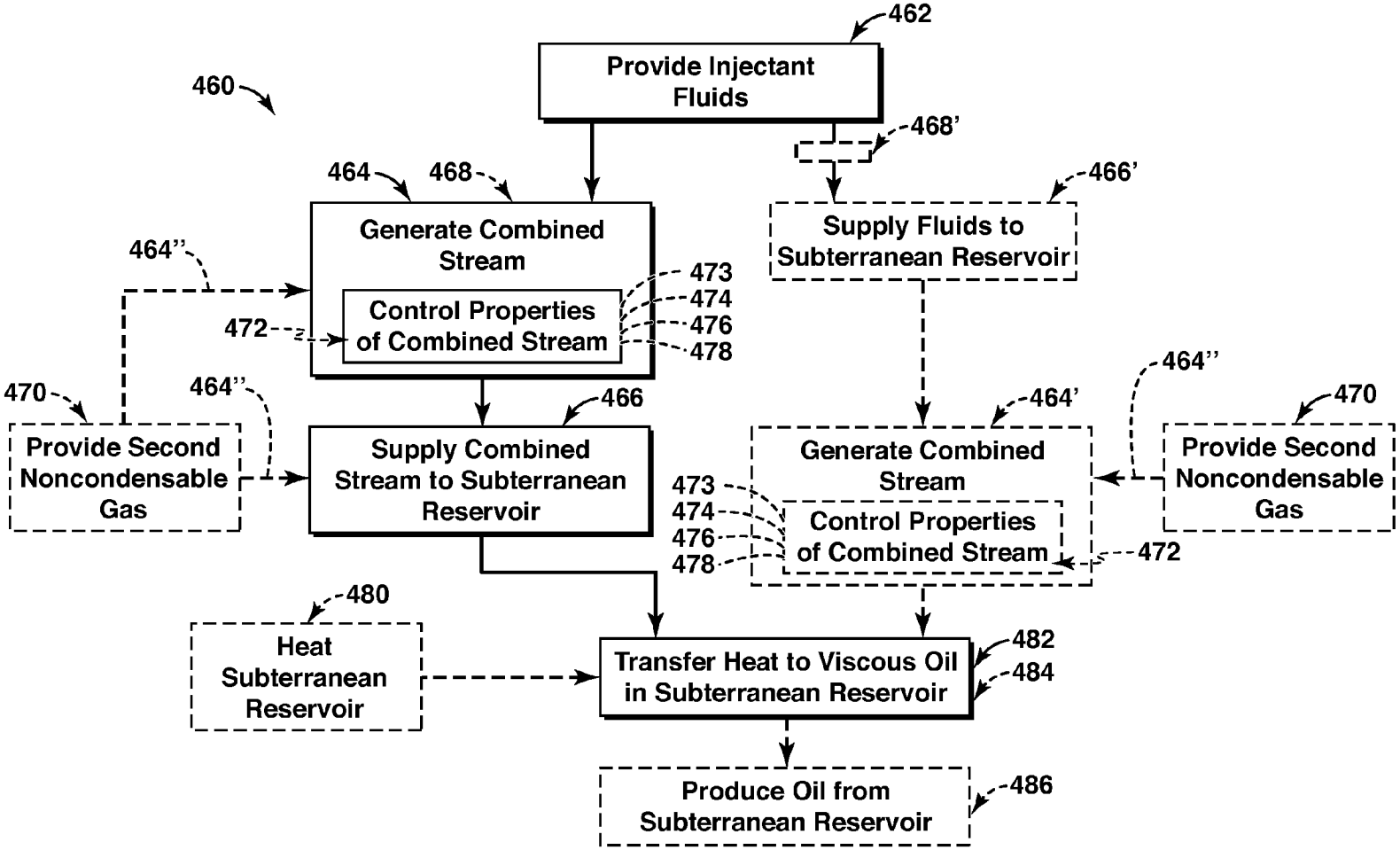
FIG. 7 is a flow chart depicting illustrative, non-exclusive examples of methods according to the present disclosure.

The systems disclosed herein may be utilized with any suitable method of operation. An illustrative, non-exclusive example of methods 460 according to the present disclosure is shown in FIG. 7. In FIG. 7 (as with the other Figures of the present disclosure), optional steps and/or components may be shown in dashed lines. As indicated at 462, the methods may include providing the injectant fluid streams, such as to one or more mixing vessels, common vessels, or the like. This providing step typically will include providing at least liquid water and a noncondensable gas (or noncondensable gas species), but as discussed herein, may additionally or alternatively include providing steam. The provided fluids typically will be provided in separate streams, or supplies, although this is not required to all systems and/or methods according to the present disclosure. It is within the scope of the present disclosure that the providing step may be described as including a plurality of separate providing steps, such as providing liquid water (and/or a liquid water stream), providing noncondensable gas (and/or a noncondensable gas stream), etc.

Methods 460 according to the present disclosure further include generating the combined stream and supplying the combined stream to a subterranean reservoir of a subsurface region. In FIG. 7, generating the combined stream is indicated in solid lines at 464, and supplying the combined stream to the subterranean reservoir is indicated in solid lines at 466. Generating the combined stream additionally or alternatively may be referred to as generating the combined gas stream and/or generating a high-pressure mixture of steam and noncondensable gas. Supplying the combined stream to the subterranean reservoir typically will include delivering the combined stream to the subterranean reservoir of a subsurface formation via one or more wellbores.

As indicated in dashed lines at 468, the generating the combined stream may include generating steam from provided liquid water, such as liquid water provided at step 462. As further discussed, the steam may be generated prior to being mixed with the noncondensable gas, such as by providing the steam from a separate steam source, or it may be generated in the presence of the noncondensable gas, such as after providing liquid water and the noncondensable gas to a common vessel, such as a pressure vessel, boiler, pipe, etc. designed to contain a combined stream having sufficient pressure for use in the deep-steam injection methods described herein.

The combined stream produced in generating step 464 may have any of the properties and/or compositions discussed herein, illustrative, non-exclusive examples of which include a combined stream that has a total pressure that is at least 75%, at least 90%, at least 100%, and/or greater than the critical pressure of pure water, a combined stream that contain at least 5 mol % noncondensable gas, a combined stream that contains at least 50 mol % steam, and/or a combined stream that has a partial pressure of steam that is less than the critical pressure of pure water.

As also indicated in dashed lines in FIG. 7, and as discussed herein, it is within the scope of the present disclosure for the steam and the noncondensable gas to be supplied to the subsurface formation, or even to the subterranean reservoir thereof, prior to forming the combined stream by mixing the steam and noncondensable gas. Although many applications will likely include forming the combined stream at, or within, the surface region, these variants also are possible and are within the scope of the present disclosure. This is graphically indicated in FIG. 7 in dashed lines, in which the injectant fluids are supplied to the subterranean reservoir at 466' and the combined stream is generated within the subterranean reservoir at 464'. When this method is utilized and liquid water is provided as an injectant fluid, steam may be generated from the liquid water, as indicated at 468', at one or more of a variety of locations. Illustrative, non-exclusive examples of such locations include generating the steam within the surface region, within the subterranean region prior to mixing with the noncondensable gas, or within the subterranean region after mixing (or otherwise containing in a common vessel) of a water stream with the noncondensable gas.

As illustrative, non-exclusive examples, and with reference to FIGS. 5-6, the steam stream may be generated at, or within, surface region 102 (i.e., not within the subterranean reservoir) and supplied to subterranean reservoir 20. Concurrently, the noncondensable gas stream may be supplied to subterranean reservoir 20, and the steam and noncondensable gas may be combined within subterranean reservoir 20 to produce combined stream 420. As another illustrative, non-exclusive example, the steam stream may be generated and combined with the noncondensable gas stream at, or within, surface region 102 to generate combined stream 420, which is then supplied to the subterranean reservoir, such as via the wellbore. As yet another illustrative, non-exclusive example, a water stream and a noncondensable gas stream may be supplied to mixing volume 416, where the water stream may be vaporized and mixed with the noncondensable gas stream, forming combined stream 420. Although not required to all systems and/or methods according to the present disclosure, all or a portion of mixing volume 416 may be located in surface region 102, wellbore 108, and/or subterranean reservoir 20.

Returning to FIG. 7, and as indicated at 472, the methods may include regulating or otherwise controlling one or more properties of the combined stream. An illustrative, non-exclusive example of such a property is the mole fraction of steam in the combined stream, as indicated at 473. For example, and with reference to FIGS. 5-6, the mole fraction of steam in the combined stream may be controlled by controlling the supply of steam, water, and/or noncondensable gas, and/or the supply of heat energy, to mixing volume 416. The mole fraction of steam may be controlled to be within a threshold amount of a target value. Illustrative, non-exclusive examples of target values according to the present disclosure include target values in the range of 5% to 95% steam on a molar basis, including target values of greater or less than any of 40%, 50%, 60%, 70%, and/or 80% steam on a molar basis. Illustrative, non-exclusive examples of threshold amounts according to the present disclosure include threshold amounts of ±25%, ±15%, ±10%, ±5%, or ±1% on a molar basis.

Another illustrative, non-exclusive example of a property of the combined stream that may be regulated or otherwise controlled is the mole fraction of noncondensable gas in the combined stream, as indicated in FIG. 7 at 474. This may be accomplished in a manner similar to that disclosed with respect to controlling the mole fraction of steam at 473. Similar to the mole fraction of steam, the mole fraction of noncondensable gas may be controlled to be within a threshold amount of a target value. Illustrative, non-exclusive examples of target values according to the present disclosure include target values in the range of 1% to 99% noncondensable gas on a molar basis, including target values of greater or less than any of 5%, 10%, 20%, 30%, 40%, 50%, 60%, 70%, and/or 80% noncondensable gas on a molar basis. Illustrative, non-exclusive examples of threshold amounts according to the present disclosure include threshold amounts of ±25%, ±15%, ±10%, ±5%, or ±1% on a molar basis.

As indicated in FIG. 7 at 470, the methods may include providing a second noncondensable gas stream, and they may further include mixing the second noncondensable gas stream with the combined stream, as indicated at 464". When a second noncondensable gas is added to the combined stream or otherwise utilized in systems and/or methods according to the present disclosure, the previously discussed noncondensable gas (412) may (but is not required to) be referred to as a first noncondensable gas (or noncondensable gas species). As schematically indicated in FIG. 7, it is within the scope of the present disclosure that this mixing may occur prior to or after generation of the combined stream from the steam and the (first) noncondensable gas and/or before or after supplying of the combined stream (or components thereof) to the subterranean reservoir.

As discussed herein, the second noncondensable gas stream may comprise any suitable material and may be similar in chemical composition to the first noncondensable gas stream. Additionally or alternatively, the first and second noncondensable gas streams may have different chemical compositions. One or more of the noncondensable gas streams may be supplied from a source external to the hydrocarbon production system. Additionally or alternatively, one or more of the noncondensable gas streams may be supplied from a source internal to the hydrocarbon production system. As an illustrative, non-exclusive example, one or more of the noncondensable gas streams may comprise at least a portion of the produced fluid from the subterranean reservoir (or subsurface formation), such as natural gas, which may be produced from the subterranean reservoir as a produced noncondensable gas stream.

This second noncondensable gas stream may be utilized for a variety of purposes, including to assist in the regulation or other control of the properties of the combined stream.

For example, the mole fraction of steam and/or noncondensable gas in the combined stream may be controlled by regulating whether or not the second noncondensable gas is supplied or otherwise provided, and if so, the flow rate (and/or other properties) of the second noncondensable gas stream. For example, the mole fraction of steam in the combined stream may be reduced by the addition of second noncondensable gas, with a corresponding increase in the overall mole fraction of noncondensable gas.

A further illustrative, non-exclusive example of a property of the combined stream that may be regulated or otherwise controlled is the total pressure of the combined stream, as indicated in FIG. 7 at 476. This may include controlling the total pressure to be within a threshold amount of a total pressure target value. Illustrative, non-exclusive examples of total pressure target, or threshold, values according to the present disclosure include target values of at least 2000 psia, at least 2400 psia, at least 2800 psia, at least 3000 psia, at least 3200 psia, at least 3600 psia, and/or at least 4000 psia. Illustrative, non-exclusive examples of threshold amounts according to the present disclosure include threshold amounts of less than ±500 psia, ±250 psia, ±100 psia, ±50 psia, and/or ±10 psia.

Yet another illustrative, non-exclusive example of a property of the combined stream that may be regulated or otherwise controlled is the partial pressure of steam within the combined stream, as indicated in FIG. 7 at 478, such as to be within a threshold amount of a steam partial pressure target value. Illustrative, non-exclusive examples of steam partial pressure target values according to the present disclosure include pressures of at least 1000 psi, at least 1500 psi, at least 2000 psi, at least 2500 psi, at least 3000 psi, and/or at least 3200 psi. Illustrative, non-exclusive examples of threshold amounts according to the present disclosure include threshold amounts of less than ±500 psia, ±250 psia, ±100 psia, ±50 psia, and/or ±10 psia.

The methods may further include providing supplemental heat to the combined stream, the wellbore, and/or the subterranean reservoir, as indicated in FIG. 7 at 480. This supplemental heating may utilize steam, an electric heater, a fuel-fired heater, and/or any other suitable heat source and may be generated within the surface region, within the wellbore, and/or within the subsurface formation. The supplemental heating may be utilized to preheat various components of the hydrocarbon production system, to increase the temperature of the combined stream, and/or to maintain the temperature of system components.

As an illustrative, non-exclusive example, and with reference to FIGS. 5-6, well preheat stream 448 in the form of steam may be injected into wellbore 108 prior to the injection of combined stream 420. Steam may be more economical to produce than combined stream 420 and may preheat the wellbore, decreasing the thermal energy loss from the combined stream when it is subsequently supplied to the wellbore. However, and as discussed herein, if wellbore 108 is part of a deep oil reservoir, steam may not effectively heat the entire length of the wellbore. As another illustrative, non-exclusive example, wellbore 108 and/or subsurface formation 200 may include down-hole heater 140, such as electric heater 144 and/or fuel-fired heater 148. The down-hole heater may be utilized to increase the temperature of the combined stream as it is injected into subsurface formation 200, which may recover a portion of the thermal energy lost as the combined stream travels down wellbore 108 and/or increase the temperature of the combined stream above its initial temperature. As yet another illustrative, non-exclusive example, steam and/or the down-hole heater may be utilized to maintain the temperature of various components of hydrocarbon production system 10, such as wellbore 108 and/or subsurface formation 200 during periods of time in which combined stream 420 may not be supplied to the subsurface formation.

The methods also may include transferring thermal energy from the combined stream to the viscous oil contained within the subterranean reservoir, as indicated at 482. The average in situ viscosity of the viscous oil contained within the subterranean reservoir may vary significantly from formation to formation and/or within a given formation. Illustrative, non-exclusive examples of in situ viscosities according to the present disclosure include viscosities of greater than 5 cp, greater than 10 cp, greater than 100 cp, greater than 1,000 cp, or greater than 10,000 cp. This in situ viscosity of the viscous oil may refer to the viscosity of the oil prior to being heated by the combined stream. Responsive to this transfer of thermal energy from the combined stream to the viscous oil contained within the subterranean reservoir, the viscosity of the viscous oil may be decreased, as indicated at 484. Illustrative, non-exclusive examples of viscosity decreases according to the present disclosure include viscosity decreases of at least 5%, including viscosity decreases of at least 10%, at least 25%, at least 50%, at least 75%, or at least 90%.

The methods may further include producing oil from the subterranean reservoir, as indicated in FIG. 7 at 486. This may include the use of the combined stream in any suitable steam-assisted oil recovery process. Illustrative, non-exclusive examples of these processes include steam assisted gravity drainage, cyclic steam simulation, steamflooding, steam soak, and cyclic steamflooding and are discussed herein.

It is within the scope of the present disclosure that supplying step 466 (and/or 466') may include supplying the water stream, the steam stream, the noncondensable gas stream, and/or the combined stream to any suitable depth within the subterranean reservoir. Illustrative, non-exclusive examples include depths of less than 3000 feet, such as depths of less than 2500 feet or depths of less than 2000 feet, as well as depths of 3000 feet or more, such as depths of greater than 3000 feet or depths of greater than 3500 feet. It is further within the scope of the present disclosure that one or more of the supplying steps may be performed concurrently.

Figure 8:
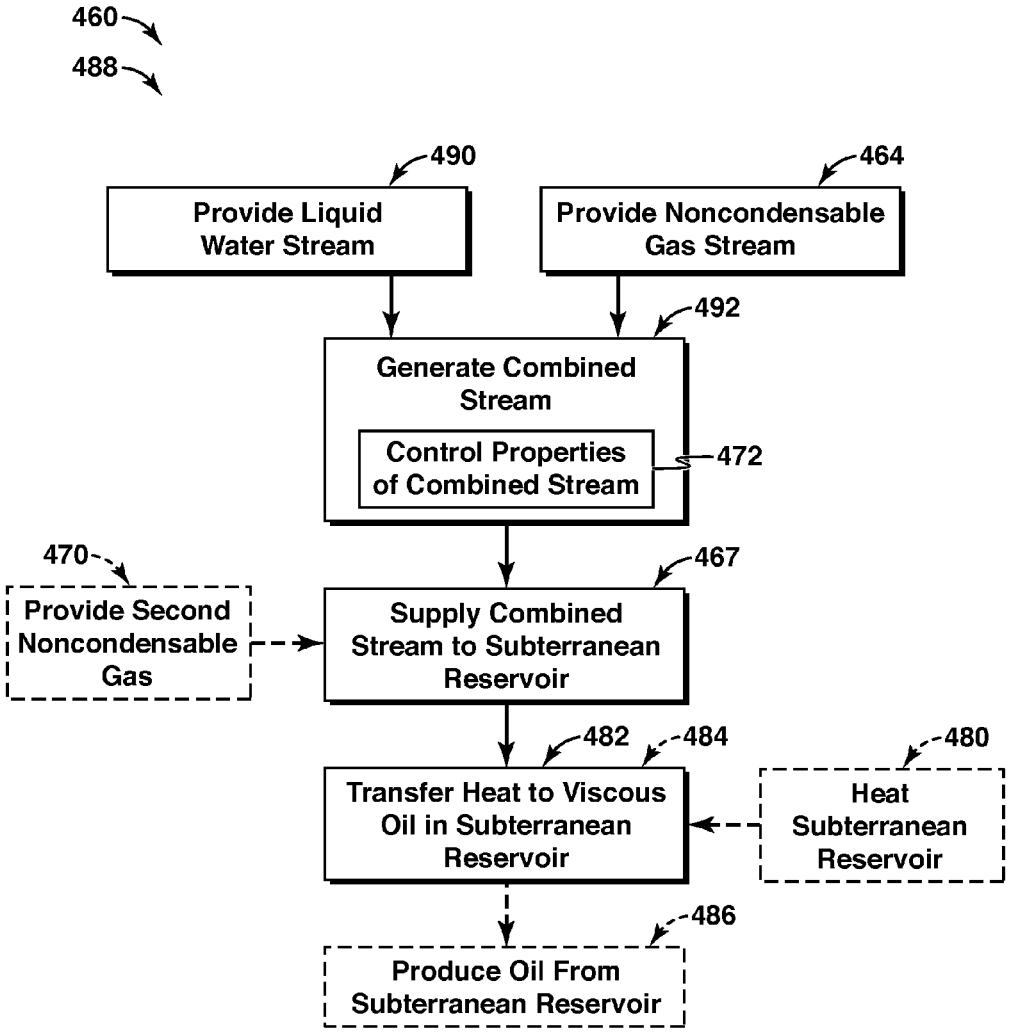
FIG. 8 is another flow chart depicting illustrative, non-exclusive examples of methods according to the present disclosure.

Additional illustrative, non-exclusive examples of methods 460 according to the present disclosure are schematically illustrated in FIG. 8, with the more specific methods of FIG. 8 being indicated at 488. The methods may include supplying a liquid water stream at 490 and a noncondensable gas stream at 464 and heating and mixing the two streams within a fluid heating assembly at 492 to generate a combined stream. Similar to the methods 460 discussed in FIG. 7, the generating step may include regulating or otherwise controlling the properties of the combined stream, as indicated at 472. When utilized, this regulating or controlling step may include any of the illustrative, non-exclusive examples of such properties and/or control methods that have been discussed herein. As also indicated in FIG. 8, the methods optionally may include providing a second noncondensable gas stream, as indicated at 470, which may form a portion of the combined stream, and which may be utilized to assist in the regulation (and/or maintenance) of the properties of the combined stream that is ultimately utilized in the subterranean reservoir. As indicated in FIG. 8, methods 488 may further include supplying the combined stream to the subterranean formation, as indicated at 467, transferring thermal energy to the viscous oil contained within the subterranean formation, as indicated at 482, heating the subterranean reservoir, as indicated at 480, reducing the viscosity of the viscous oil, as indicated at 484, and/or producing oil from the subterranean formation, as indicated at 486.

The systems and methods disclosed herein have been described with reference to coinjection of steam and a noncondensable gas into deep oil reservoirs; however, it is within the scope of the present disclosure that they may be utilized with any suitable reservoir depth. While the ambient pressure within deep oil reservoirs may preclude the use of traditional steam injection techniques and suggest the use of enhanced steam injection techniques, such as coinjection with a noncondensable gas, the recovery of oil from shallower reservoirs also may be improved through the use of the systems and methods described herein. As an illustrative, non-exclusive example, and as discussed herein, coinjection may increase the maximum pressure and/or maximum pressure gradient attainable within a subsurface formation. This may increase the driving force for steam injection and/or oil production, and may facilitate faster recovery of oil and/or a higher steam injection rate than may be obtained using traditional steam injection techniques. As another illustrative, non-exclusive example, the presence of a noncondensable coinjectant may maintain the subsurface formation at a higher pressure over a longer period of time than may be obtained without the coinjectant. Under these conditions, the coinjectant may remain in the gas phase as the temperature within the reservoir decreases and the steam is condensed.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" may mean A alone, B alone, C alone, A and B together, A and C together, B and C together, A, B and C together, and optionally any of the above in combination with at least one other entity.

In the event that any of the references that are incorporated by reference herein define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A. A method of injecting steam into a subterranean viscous oil reservoir that includes a wellbore, the method comprising:

generating a steam stream;

supplying at least a portion of the steam stream to the oil reservoir;

providing a noncondensable gas stream;

supplying at least a portion of the noncondensable gas stream to the oil reservoir; and combining the steam stream and the noncondensable gas stream to produce a combined stream at a combined stream total pressure that exceeds the critical pressure of water, wherein the combined stream total pressure includes at least a steam partial pressure and a noncondensable gas partial pressure.

A1. The method of paragraph A, wherein combining the steam stream and the noncondensable gas stream includes combining the steam stream and the noncondensable gas stream such that the steam partial pressure is less than 3200 pounds per square inch absolute pressure (22.06 MPa).

A2. The method of any of paragraphs A-A1, wherein the steam partial pressure is between 1000 and 3000 pounds per square inch absolute pressure (6.9 MPa and 20.7 MPa).

A3. The method of any of paragraphs A-A2, wherein the steam partial pressure is between 1500 and 2500 pounds per square inch absolute pressure (10.3 MPa and 17.2 MPa).

A4. The method of any of paragraphs A-A3, wherein the steam partial pressure is between 1500 and 2000 pounds per square inch absolute pressure (10.3 MPa and 13.8 MPa).

A5. The method of any of paragraphs A-A4, wherein the generating and the combining steps are performed simultaneously.

A6. The method of any of paragraphs A-A5, wherein the combining includes combining within a fluid heating assembly.

A7. The method of paragraph A6, wherein at least a portion of the fluid heating assembly is located within the wellbore.

A8. The method of paragraph A6, wherein the fluid heating assembly is not located within the wellbore.

A9. The method of any of paragraphs A6-A8, wherein the fluid heating assembly includes a boiler tank.

A10. The method of any of paragraphs A6-A9, wherein the fluid heating assembly includes a heated pipe.

A11. The method of any of paragraphs A-A10, wherein the combining occurs prior to the supplying, and further wherein the supplying includes supplying the combined stream to the oil reservoir.

A12. The method of paragraph A11, wherein the method further comprises injecting a preheat steam stream to heat the wellbore prior to supplying the combined stream.

A13. The method any of paragraphs A11-A12, wherein the method further comprises supplying the combined stream as part of a steamflood process.

A14. The method of any of paragraphs A11-A13, wherein the method further comprises supplying the combined stream as part of a steam assisted gravity drainage process.

A15. The method of any of paragraphs A11-A14, wherein the method further comprises supplying the combined stream as part of a cyclic steam stimulation process.

A16. The method of any of paragraphs A11-A15, wherein supplying the combined stream to the oil reservoir includes supplying the combined stream into the wellbore to a depth of at least 3000 feet (914 m).

A17. The method of any of paragraphs A11-A16, wherein supplying the combined stream to the oil reservoir includes supplying the combined stream into the wellbore to a depth of at least 3500 feet (1067 m).

A18. The method of any of paragraphs A-A17, wherein the noncondensable gas stream is a first noncondensable gas stream, and the method further comprises combining a second noncondensable gas stream with the combined stream.

A19. The method of paragraph A18, wherein the second noncondensable gas stream has a different composition than the first noncondensable gas stream.

A20. The method of any of paragraphs A-A19, wherein the oil reservoir contains oil with an initial in situ viscosity of at least 10 centipoise.

A21. The method of any of paragraphs A-A20, wherein the oil reservoir contains oil with an initial in situ viscosity of at least 100 centipoise.

A22. The method of any of paragraphs A-A21, wherein the method further comprises placing the combined stream in thermal communication with a viscous oil deposit within the reservoir to reduce the viscosity of the viscous oil deposit.

A23. The method of any of paragraphs A-A22, wherein at least a portion of the noncondensable gas stream is produced from the oil reservoir into which the noncondensable gas stream is supplied.

A24. The method of any of paragraphs A-A23, wherein the noncondensable gas includes methane.

A25. The method of any of paragraphs A-A24, wherein the noncondensable gas includes natural gas.

A26. The method of any of paragraphs A-A25, wherein the noncondensable gas includes at least a first component, and further wherein the first component is selected from the group consisting of carbon dioxide, nitrogen, ethane, propane, butane, and pentane.

A27. The method of any of paragraphs A-A26, wherein the combined stream includes at least 50 mole percent water.

A28. The method of any of paragraphs A-A27, wherein the combined stream includes at least 70 mole percent water.

A29. The method of any of paragraphs A-A28, wherein the combined stream includes at least 5 mole percent noncondensable gas, and optionally wherein the combined stream includes at least 20 mole percent noncondensable gas.

A30. The method of any of paragraphs A-A29, wherein the method further comprises heating the combined stream within the wellbore.

A31. The method of paragraph A30, wherein the wellbore contains a resistive electric heater, and further wherein heating the combined stream within the wellbore includes heating the combined stream with the resistive electric heater.

A32. The method of any of paragraphs A30-A31, wherein the wellbore contains a closed-loop down-hole burner, and further wherein heating the combined stream within the wellbore includes heating the combined stream with the closed-loop down-hole burner.

A33. The method of any of paragraphs A-A32, wherein the wellbore further includes insulation adapted to decrease the heat loss from the combined stream to the wellbore.

A34. The method of any of paragraphs A-A34, wherein the method further comprises producing oil from the oil reservoir.

B. A method of generating a combined stream including steam and a noncondensable gas, the method comprising:

supplying a water stream to a fluid heating assembly;

supplying a noncondensable gas stream to the fluid heating assembly;

heating the water stream and the noncondensable gas stream at the fluid heating assembly; and generating the combined stream from the fluid heating assembly at a combined stream total pressure, wherein the combined stream includes at least steam and the noncondensable gas and further wherein the combined stream total pressure includes at least a steam partial pressure and a noncondensable gas partial pressure.

B1. The method of paragraph B, wherein the combined stream total pressure is at least 2400 pounds per square inch absolute pressure (16.5 MPa).

B2. The method of any of paragraphs B-B1, wherein the combined stream total pressure is greater than the critical pressure of water.

B3. The method of any of paragraphs B-B2, wherein the steam partial pressure is less than the critical pressure of water.

B4. The method of any of paragraphs B-B3, wherein the method further comprises supplying at least a portion of the combined stream to a subterranean viscous oil reservoir.

B5. The method of any of paragraphs B-B4, wherein the method further comprises producing oil from the oil reservoir.

C. A method of recovering oil from a subterranean viscous oil reservoir that includes a wellbore, the method comprising:

supplying a water stream to a fluid heating assembly to produce a steam stream;

supplying a noncondensable gas stream to the fluid heating assembly;

generating a combined stream at the fluid heating assembly at a combined stream total pressure that exceeds the critical pressure of water, wherein the combined stream total pressure includes at least a steam partial pressure and a noncondensable gas partial pressure and further wherein the steam partial pressure is less than the critical pressure of water;

supplying at least a portion of the combined stream to the subterranean viscous oil reservoir; and producing oil from the oil reservoir.

D. A method of recovering oil from a subterranean viscous oil reservoir that includes a wellbore, the method comprising:

a step for supplying a water stream;

a step for supplying a noncondensable gas stream;

a step for generating a combined stream at a combined stream total pressure from at least the water stream and the noncondensable gas stream, wherein the combined stream total pressure includes at least a steam partial pressure and a noncondensable gas partial pressure;

a step for supplying at least a portion of the combined stream to the subterranean viscous oil reservoir; and a step for producing oil from the oil reservoir.

D1. The method of paragraph D, wherein the step for generating the combined stream further includes a step for generating the combined stream at a pressure that exceeds the critical pressure of water.

D2. The method of any of paragraphs D-D1, wherein the step for generating a combined stream further includes a step for generating the combined stream wherein the steam partial pressure is less than the critical pressure of water.

E. A method of recovering oil from a subterranean viscous oil reservoir, the method comprising:

injecting via at least one injection well a vapor mixture of steam plus one or more noncondensable gas species into the subterranean viscous oil reservoir, wherein the vapor mixture enters the reservoir at a pressure exceeding the critical pressure of pure water, the vapor mixture comprises at least 50 mol % water, and the vapor mixture comprises at least 5 mol % of the noncondensable gas species;

contacting viscous oil in the reservoir with the vapor mixture, wherein the contacting includes reducing the viscosity of the viscous oil; and producing reduced-viscosity viscous oil through at least one production well.

E1. The method of paragraph E, wherein the vapor mixture is generated in a surface vessel where water and at least a portion of the noncondensable gas species are mixed and heated.

E2. The method of paragraph E1, wherein the surface vessel includes a boiler tank.

E3. The method of any of paragraphs E1 -E2, wherein the surface vessel includes a heated pipe.

E4. The method of any of paragraphs E-E3, wherein at least a portion of the noncondensable gas species is selected from the group consisting of methane, natural gas, nitrogen, and carbon dioxide.

E5. The method of any of paragraphs E-E4, wherein the vapor mixture comprises at least 70 mole percent water.

E6. The method of any of paragraphs E-E5, wherein the method further comprises preheating one or more of the injection wells by injection of steam that is not mixed with the noncondensable gas species.

E7. The method of any of paragraphs E-E6, wherein the method further comprises heating a least a portion of the vapor mixture within the injection well.

E8. The method of paragraph E7, wherein the heating includes heating with a resistive electric heater.

E9. The method of any of paragraphs E7-E8, wherein the heating includes heating with a closed-loop down-hole burner.

E10. The method of any of paragraphs E-E9, wherein the method further comprises injecting the vapor mixture as part of a steamflood recovery process.

E11. The method of any of paragraphs E-E10, wherein the method further comprises injecting the vapor mixture as part of a steam assisted gravity drainage process.

E12. The method of any of paragraphs E-E11, wherein the method further comprises, injecting the vapor mixture as part of a cyclical injection process, and optionally wherein the well may act as both an injection well and a production well.

E13. The method of any of paragraphs E-E12, wherein the vapor mixture is injected to a depth of at least 3000 feet (914 m).

E14. The method of any of paragraphs E-E13, wherein at least a portion of the noncondensable gas species is produced from the subterranean reservoir.

E15. The method of any of paragraphs E-E14, wherein the partial pressure of steam in the vapor mixture is less than the critical pressure of water.

E16. The method of any of paragraphs E-E15, wherein the partial pressure of steam in the vapor mixture is between 1000 and 3000 psia (6.9 MPa and 20.7 MPa).

F. A method of recovering oil from a subsurface reservoir, the method comprising:

injecting via at least one injection well a vapor mixture of steam plus noncondensable gas species into the subsurface reservoir, wherein the vapor mixture enters the reservoir at a pressure of at least 2400 psia (16.5 MPa), the vapor mixture comprises at least 50 mol % water, the vapor mixture comprises at least 5 mol % noncondensable gas species, and the vapor mixture is generated in a surface vessel where water and at least a portion of the noncondensable gas are mixed and heated;

contacting the vapor mixture with viscous oil within the reservoir thereby reducing the viscosity of the viscous oil; and producing reduced-viscosity oil through at least one production well.

G. Oil produced by the method of any of paragraphs A34, B5, C, D, E, or F.

INDUSTRIAL APPLICABILITY

The systems and methods for the creation and/or injection of mixtures of noncondensable gas and steam discussed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of recovering oil from a subterranean oil reservoir that includes a wellbore, the method comprising:

supplying a water stream to a fluid heating assembly, wherein the fluid heating assembly comprises a heater and a mixing volume;

supplying a noncondensable gas stream to the fluid heating assembly;

generating a heat stream with the heater, wherein the heat stream comprises heat;

heating the water stream and the noncondensable gas stream, wherein the heating consists of transferring the heat stream from the heater to the water stream and the noncondensable as stream;

generating a combined stream, comprising the water stream and the noncondensable gas stream, in the mixing volume at a combined stream total pressure that exceeds a critical pressure of water, wherein the combined stream total pressure includes a steam partial pressure and a noncondensable gas partial pressure, and wherein the steam partial pressure is less than the critical pressure of water; and supplying a portion of the combined stream to the subterranean oil reservoir.

2. The method of claim 1, wherein the steam partial pressure is less than 3200 pounds per square inch absolute pressure (22.06 MPa).

3. The method of claim 2, wherein the steam partial pressure is between 1000 and 3000 pounds per square inch absolute pressure (6.9 MPa and 20.7 MPa).

4. The method of claim 1, wherein the combined stream includes at least 50 mole percent water.

5. The method of claim 1, wherein the combined stream includes at least 70 mole percent water.

6. The method of claim 1, wherein the combined stream includes at least 5 mole percent noncondensable gas.

7. The method of claim 1, wherein the combined stream includes at least 20 mole percent noncondensable gas.

8. The method of claim 1, wherein a portion of the fluid heating assembly is within the wellbore.

9. The method of claim 1, wherein the fluid heating assembly is not located within the wellbore.

10. The method of claim 9, wherein supplying the combined stream to the oil reservoir includes supplying the combined stream into the wellbore to a depth of at least 3000 feet (914 m).

11. The method of claim 1, wherein the fluid heating assembly comprises a boiler tank in which the combined stream is generated.

12. The method of claim 1, further comprising injecting a preheat steam stream to heat the wellbore prior to supplying the combined stream.

13. The method of claim 1, further comprising supplying the combined stream as part of at least one of a steam flood process, a steam assisted gravity drainage process, and a cyclic steam stimulation process.

14. The method of claim 1, wherein the noncondensable gas stream is a first noncondensable gas stream, and the method further comprises combining a second noncondensable gas stream with the combined stream.

15. The method of claim 1, wherein the subterranean oil reservoir contains oil with an initial in situ viscosity of at least 10 centipoise.

16. The method of claim 1, further comprising placing the combined stream in thermal communication with a viscous oil deposit within the subterranean oil reservoir to reduce a viscosity of the viscous oil deposit.

17. The method of claim 1, wherein a portion of the noncondensable gas stream is produced from the subterranean oil reservoir into which the noncondensable gas stream is supplied.

18. The method of claim 1, wherein the noncondensable gas includes at least one of methane and natural gas.

19. The method of claim 1, wherein the noncondensable gas includes a first component, and wherein the first component is selected from the group consisting of carbon dioxide, nitrogen, ethane, propane, butane, and pentane.

20. The method of claim 1, further comprising heating the combined stream within the wellbore.

21. The method of claim 20, wherein the wellbore contains a resistive electric heater, and further wherein heating the combined stream within the wellbore includes heating the combined stream with the resistive electric heater.

22. The method of claim 20, wherein the wellbore contains a closed-loop down-hole burner, and further wherein heating the combined stream within the wellbore includes heating the combined stream with the closed-loop down-hole burner.

23. The method of claim 1, wherein the combined stream comprises steam and natural gas.

24. A method of recovering oil from a subterranean oil reservoir that includes a wellbore, the method comprising:

supplying a water stream to a fluid heating assembly, supplying a noncondensable gas stream to the fluid heating assembly;

heating the water stream and the noncondensable gas stream with a heater of the fluid heating assembly;

generating a combined stream, comprising the water stream and the noncondensable gas, in a mixing volume of the fluid heating assembly at a combined stream total pressure that exceeds a critical pressure of water, wherein the combined stream total pressure includes a steam partial pressure and a noncondensable gas partial pressure, and wherein the steam partial pressure is less than the critical pressure of water;

supplying a portion of the combined stream to the subterranean oil reservoir, and wherein the combined stream comprises steam and natural gas.

* * * * *